US012078028B2

(12) United States Patent
Anderson

(10) Patent No.: US 12,078,028 B2
(45) Date of Patent: Sep. 3, 2024

(54) THROUGH-TUBING PRESSURE INTENSIFIER, METHOD AND SYSTEM

(71) Applicant: Baker Hughes Oilfield Operations LLC, Houston, TX (US)

(72) Inventor: Gary L. Anderson, Dublin, OH (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/990,263

(22) Filed: Nov. 18, 2022

(65) Prior Publication Data

US 2024/0167362 A1 May 23, 2024

(51) Int. Cl.
*E21B 34/10* (2006.01)
*E21B 23/06* (2006.01)
*E21B 33/128* (2006.01)

(52) U.S. Cl.
CPC ..... *E21B 34/10* (2013.01); *E21B 23/06* (2013.01); *E21B 33/1285* (2013.01)

(58) Field of Classification Search
CPC ..... E21B 34/10; E21B 23/06; E21B 33/1285
See application file for complete search history.

(56) References Cited

U.S. PATENT DOCUMENTS

2001/0018977 A1* 9/2001 Kilgore ..... E21B 43/12 166/387
2004/0118610 A1* 6/2004 Grotendorst ..... E21B 49/0815 175/57
2017/0081940 A1* 3/2017 Themig ..... E21B 23/06

* cited by examiner

*Primary Examiner* — Dany E Akakpo
(74) *Attorney, Agent, or Firm* — CANTOR COLBURN LLP

(57) ABSTRACT

A through-tubing pressure intensifier, including an atmospheric chamber mandrel having a piston area, an intensifier mandrel having a piston area, the intensifier mandrel connected to the atmospheric chamber mandrel, and an intensifier chamber having a fluid disposed therein, the intensifier chamber being volumetrically reducible to expel the fluid. A hydraulic set packer assembly including a flow control nipple, a hydraulic set packer connected to the nipple, and an intensifier disposed in the packer assembly. A method for setting a hydraulic set packer in a borehole including applying pressure to an intensifier, and changing a pressure at an outlet port disposed in fluid communication with the intensifier chamber relative to an input pressure applied to the intensifier. A borehole system including a borehole in a subsurface formation, a string disposed in the borehole, and an intensifier disposed within or as a part of the string.

19 Claims, 11 Drawing Sheets

THROUGH-TUBING PRESSURE INTENSIFIER, METHOD AND SYSTEM

BACKGROUND

In the resource recovery and fluid sequestration industries there is often a need to set seals for various reasons. There can be a number of runs required to get some seals set at the desired location and it is well known that runs are expensive and time consuming. Configurations and methods that allow for fewer runs than prior art configurations and methods require relieves a budgetary burden and hence would be welcomed by the art.

SUMMARY

An embodiment of a through-tubing pressure intensifier, including an atmospheric chamber mandrel having a piston area, an intensifier mandrel having a piston area, the intensifier mandrel connected to the atmospheric chamber mandrel, and an intensifier chamber having a fluid disposed therein, the intensifier chamber being volumetrically reducible to expel the fluid.

An embodiment of a hydraulic set packer assembly including a flow control nipple, a hydraulic set packer connected to the nipple, and an intensifier disposed in the packer assembly.

An embodiment of a method for setting a hydraulic set packer in a borehole including applying pressure to an intensifier, and changing a pressure at an outlet port disposed in fluid communication with the intensifier chamber relative to an input pressure applied to the intensifier.

An embodiment of a borehole system including a borehole in a subsurface formation, a string disposed in the borehole, and an intensifier disposed within or as a part of the string.

BRIEF DESCRIPTION OF THE DRAWINGS

The following descriptions should not be considered limiting in any way. With reference to the accompanying drawings, like elements are numbered alike:

FIG. 5 is the intensifier of FIG. 1 disposed within a single-piston hydraulic set packer.

DETAILED DESCRIPTION

A detailed description of one or more embodiments of the disclosed apparatus and method are presented herein by way of exemplification and not limitation with reference to the Figures.

Figure 1A:
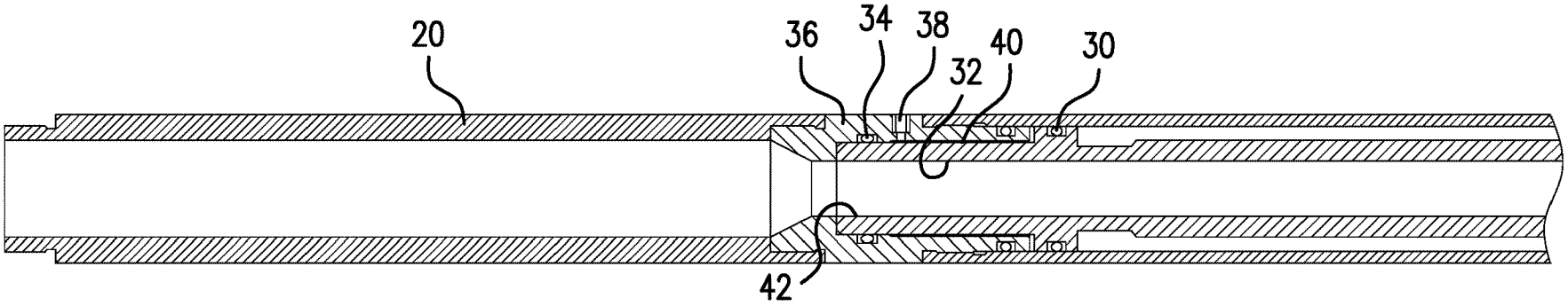
FIGS. 1A, 1B, and 1C, collectively FIG. 1 are a cross sectional view of a through-tubing pressure intensifier as disclosed herein in a run in position.
Figure 1B:
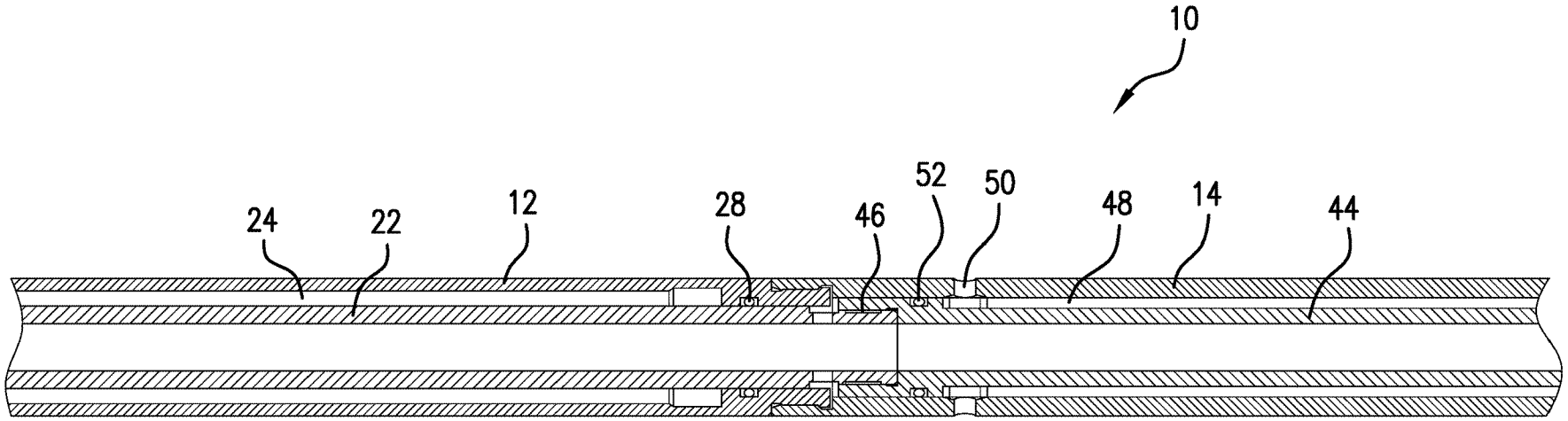
Figure 1C:
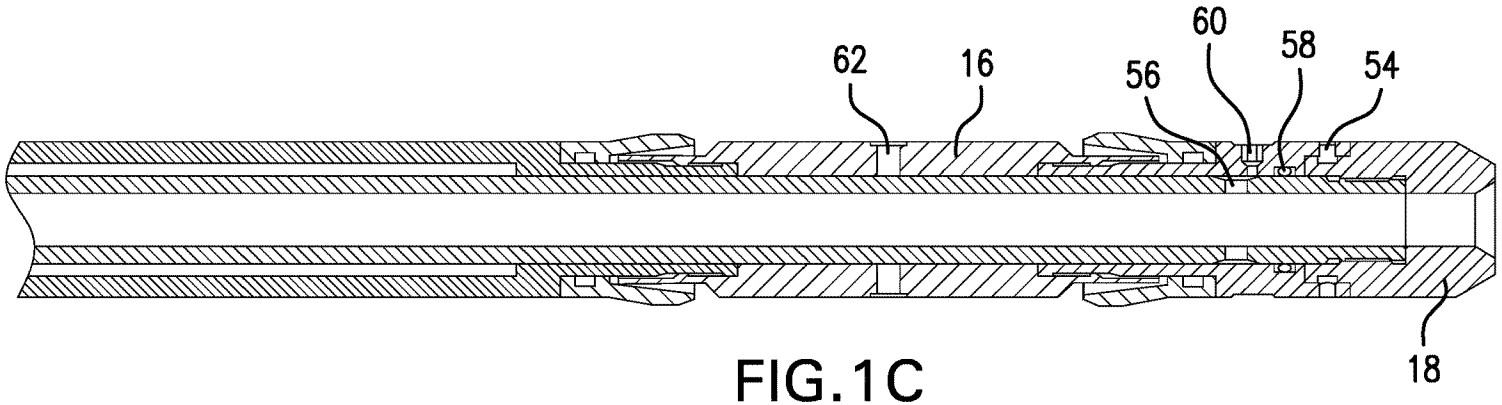

Referring to FIG. 1 (see FIGS. 1A, 1B, and 1C together), a through-tubing pressure intensifier 10 is illustrated in a run-in position. The intensifier comprises an atmospheric chamber housing 12, an intensifier housing 14, a coupling 16, and a bottom sub 18. The intensifier 10 may also include an extension 20 in some embodiments. An atmospheric chamber mandrel 22 is disposed within the atmospheric chamber housing 12 and with housing 12 defines an atmospheric chamber 24. The mandrel 22 is dynamically sealed to the housing 12 on either end thereof with seals 28 and 30. The mandrel is also sealed from pressure in an inside diameter 32 thereof by seal 34 disposed in a mandrel adapter 36. The mandrel adapter 36 further includes a valve 38 to segregate pressure external to the housing 12 from a space 40 defined by the mandrel 22, the adapter 36, the seal 34 and the seal 30. In an embodiment, the valve 38 may be a rupture disk but other valve configurations are contemplated such as an e-trigger, an e-line, a ball seat in the mandrel 22, etc. In an embodiment, it is pressure exterior to housing that triggers the movement of the intensifier 10. Specifically, in an embodiment, pressure in an annulus is raised to open the valve 38, which allows pressure to be ported to the space 40, which causes the seal 30 and mandrel 22 to slide relative to housing 12 into the atmospheric chamber 24. The sliding movement continues based upon annulus pressure until a mandrel end 42 clears seal 34, whereupon tubing pressure has access to the space 40 as well and tubing pressure may be used to continue to move mandrel 22 into the atmospheric space 24.

Still referring to FIG. 1, an intensifier mandrel 44 is attached to mandrel 22 at attachment 46. The intensifier mandrel 44 hence moves with the mandrel 22. An intensifier chamber 48 defined between the intensifier housing 14 and the intensifier mandrel 44 is auto-filled with wellbore fluid through ports 50. The intensifier mandrel 44 includes a seal 52 that during run in is on one side of the port 50 allowing the autofill and then moves to the other side of the port 50 when mandrel 22 is triggered thereby trapping the fluid that is resident in the intensifier chamber 48. This fluid is essentially incompressible and hence transmits all force imparted thereto from the tubing pressure. While the mandrel 22 and intensifier mandrel 44 move together, they cannot move until a sufficient amount of pressure is applies in space 40 to overcome a release mechanism 54, that may be a shear screw, a collet, some other interlock arrangement, etc. Near the release mechanism in FIG. 1C (not for any specific reason other than to direct the reader for easy identification) there is another auto-fill port 56 that accesses the intensifier chamber 48 to assist port 50 for auto fill during run in. There is also another seal 58 past which the port 56 moves pursuant to movement of the mandrel 22 and intensifier mandrel 44, which similar to seal 52, locks fluid in the intensifier chamber 48. Upon tubing pressure rise, the mandrel 22 and intensifier mandrel 44 will compress the intensifier chamber 48 and force fluid therein to move toward a packer (see FIG. 5) for setting of the packer. The piston area of seal 30 and seal 58 are different so that an increased pressure is created in the intensifier chamber 48 than is applied in the tubing pressure. In an embodiment, the piston area of seal 58 is 1.8 square inches and the piston area of the seal 30 is 2.8 square inches. The intensification ratio in the intensifier chamber then is 1.56. This means that if a hypothetical setting pressure of 8000 PSI is required, the intensifier 10 would require only 5128 PSI of fluid pressure from the tubing to reach the setting pressure for the packer. It is to be understood that this is only exemplary. Piston areas of the mandrel 22 and intensifier mandrel 44 may be adjusted for greater or lesser effect on the pressure created by the intensifier 10. There may also be a pressure relief valve 60 if desired to limit pressure to a maximum pressure rating for the packer. Valve 60 may be a burst disk, an e-trigger, poppet valve, etc. In some embodiments, it may be further desirable to add a flow meter in the vicinity of port 62, whether that be a nozzle, a limited orifice, a tortuous path, etc., simply to slow the fluid rush into the packer 74.

Figure 2A:
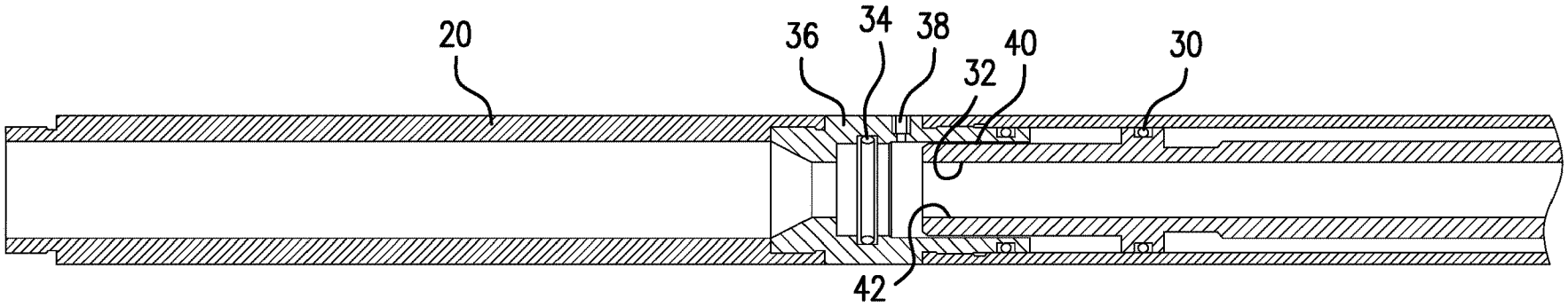
FIGS. 2A, 2B, and 2C, collectively FIG. 2 are the intensifier of FIG. 1 in a position where pressure stroke has begun.
Figure 2B:
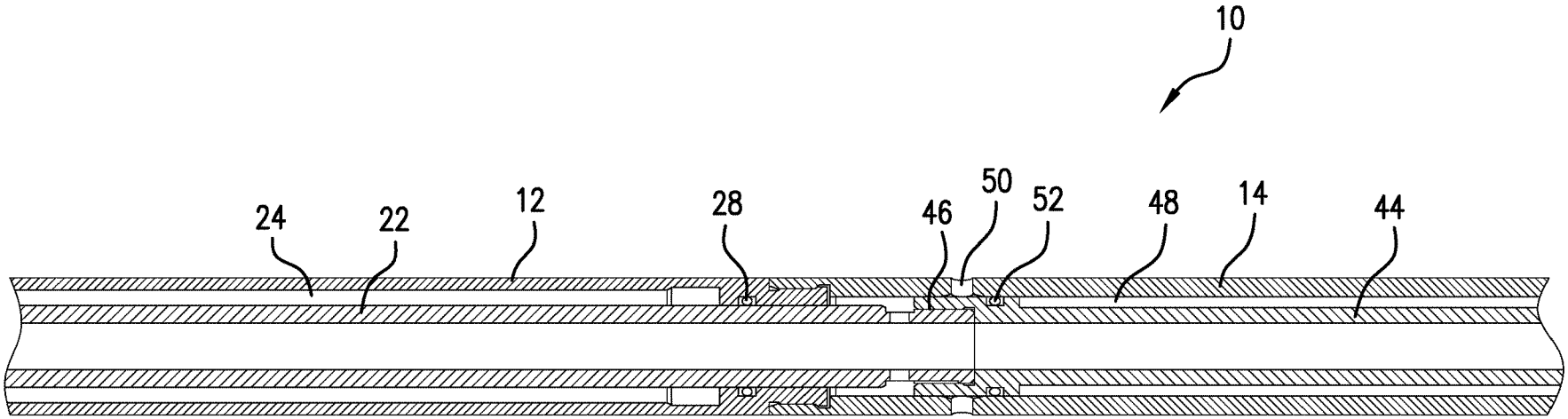
Figure 2C:
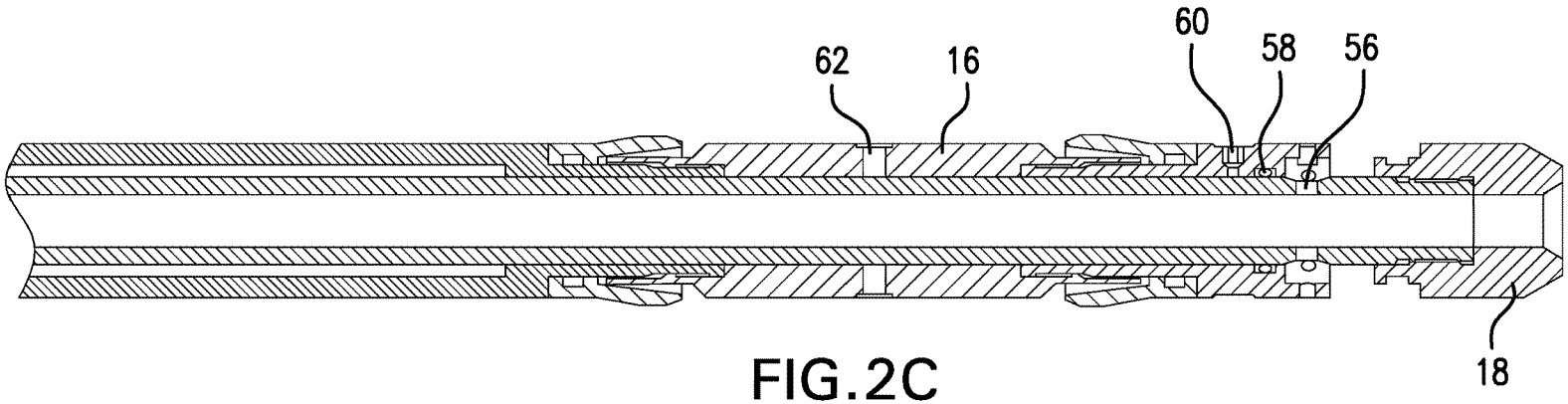
Figure 3A:
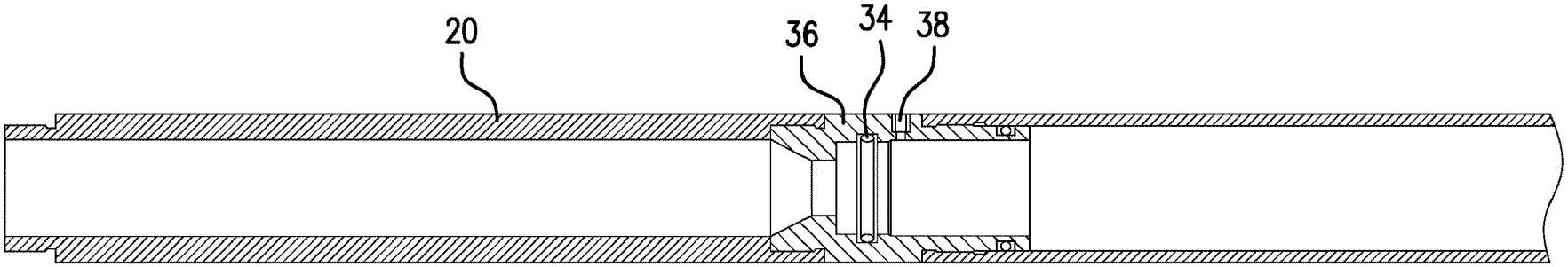
FIGS. 3A, 3B, and 3C, collectively FIG. 3 are the intensifier of FIG. 1 in a position where pressure stroke has ended.
Figure 3B:
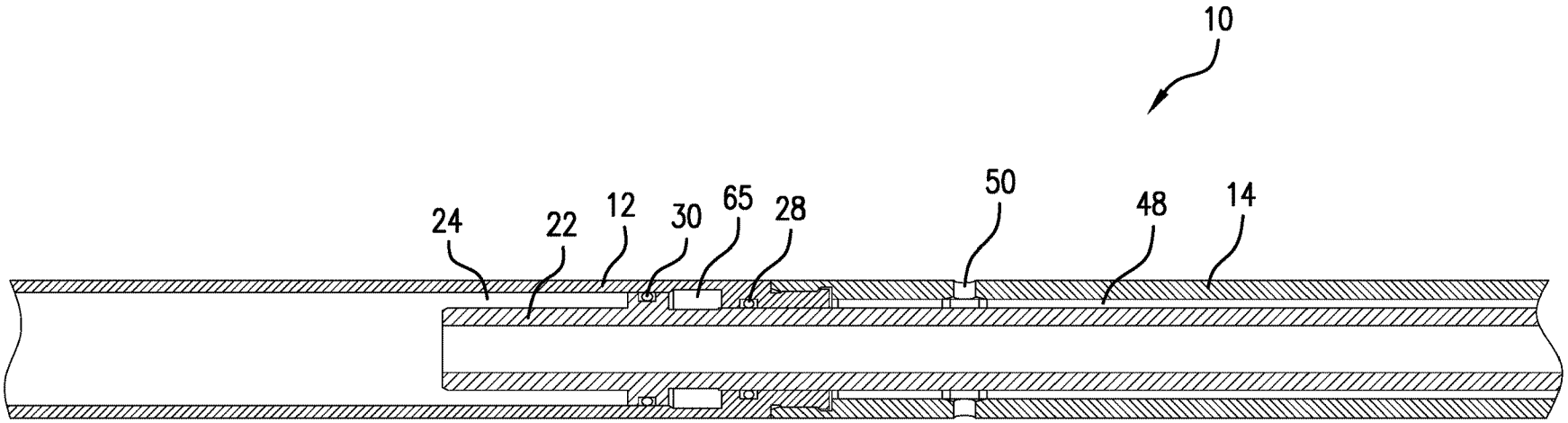
Figure 3C:
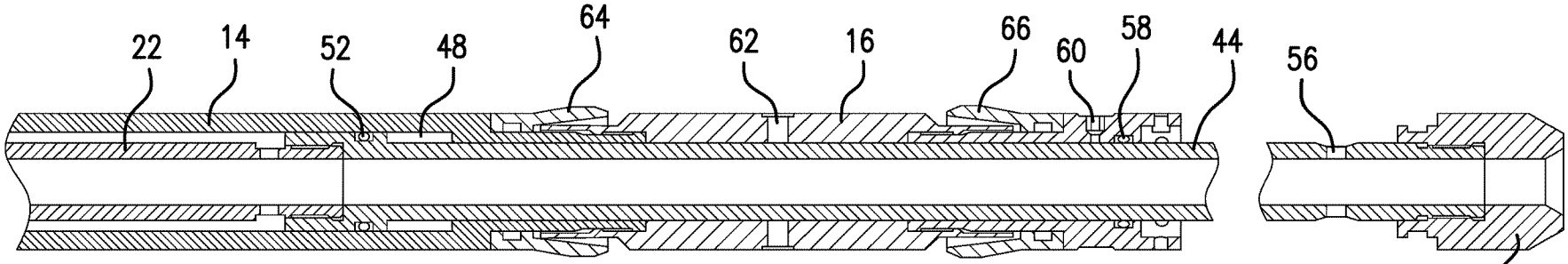
Figure 4A:
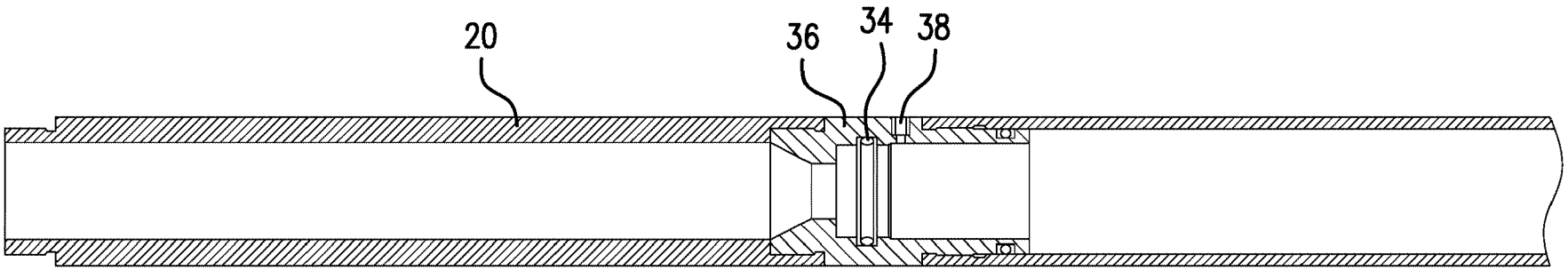
FIGS. 4A, 4B, and 4C, collectively FIG. 4 are the intensifier of FIG. 1 in a position where pressure stroke has completed.
Figure 4B:
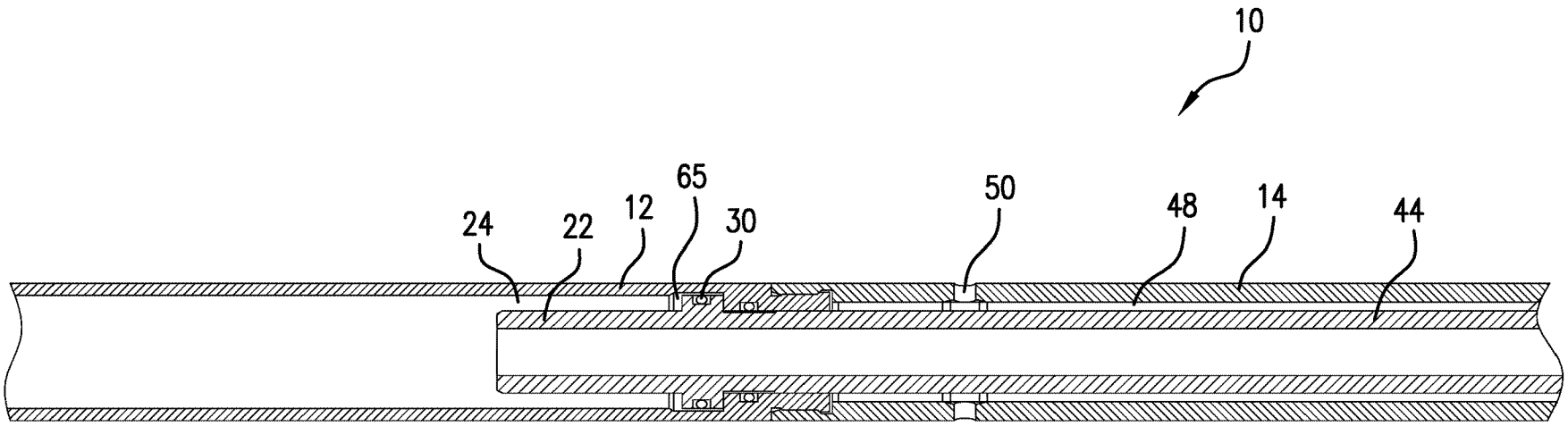
Figure 4C:
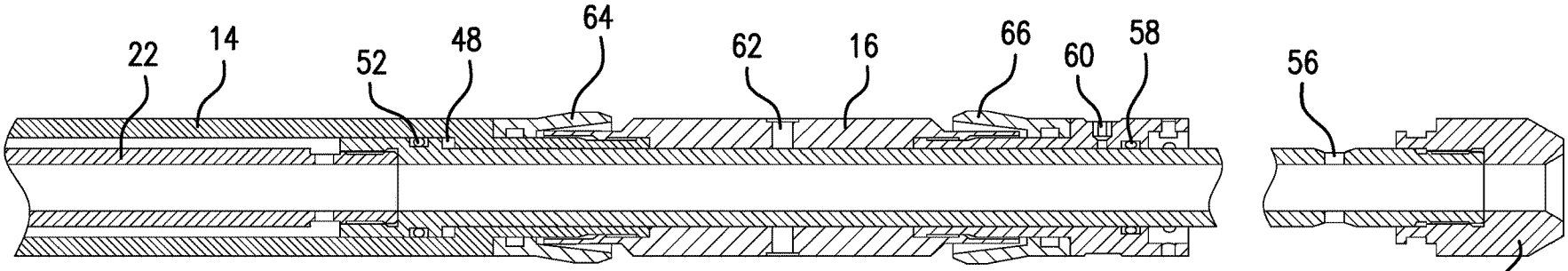

Referring to FIGS. 2, 3 and 4, various stages in the operation of the intensifier 10 are illustrated. FIG. 2 illustrates positions at the start of a pressure stroke, meaning that the valve 38 has allowed pressure to access space 40, the release member 54 has released the bottom sub 18, and the mandrel end 42 has disengaged from seal 34. Tubing pressure may now be applied to move seal 30 further into the atmospheric chamber 24 and at the same time trap the fluid in intensifier chamber 48. Continued application of tubing pressure forces fluid into the coupling 16 through port 56 and through outlet ports 62. At this stage the packer would be setting but that is discussed later herein with reference to FIG. 5. FIG. 3 illustrates the end of the pressure stroke right before pressure is equalized. It will be appreciated that seal 30 is just adjacent an undercut 65 in atmospheric chamber housing 12. The undercut 65 is of sufficient size to allow seal 30 to lose contact with housing 12 and thereby release pressure therepast. This is illustrated in the position of FIG. 4.

It will be appreciated in FIGS. 1-4 that seal 64 and seal 66 are disposed upon the coupling 16 and straddle the outlet port 62. These may be cup seals as illustrated or chevron seals or bonded seals, or any other suitable seals capable of containing the pressure that is required to set the packer.

Figure 5A:
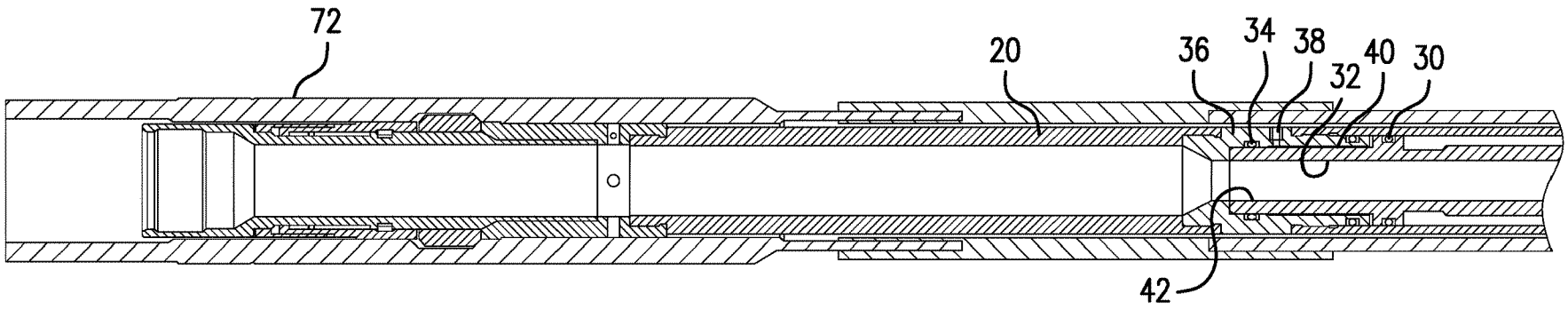
FIGS. 5A, 5B, and 5C, collectively
Figure 5B:
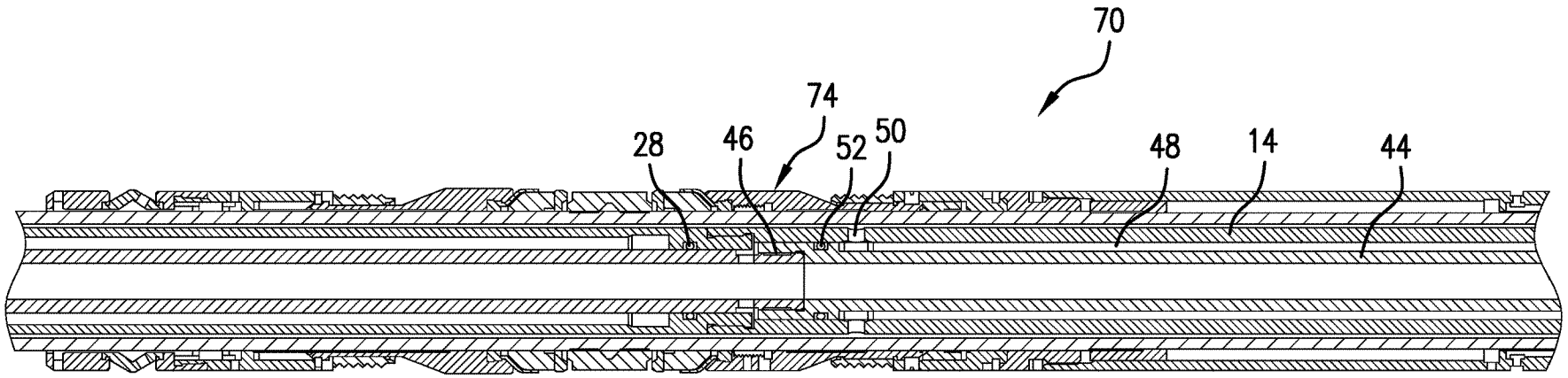
Figure 5C:
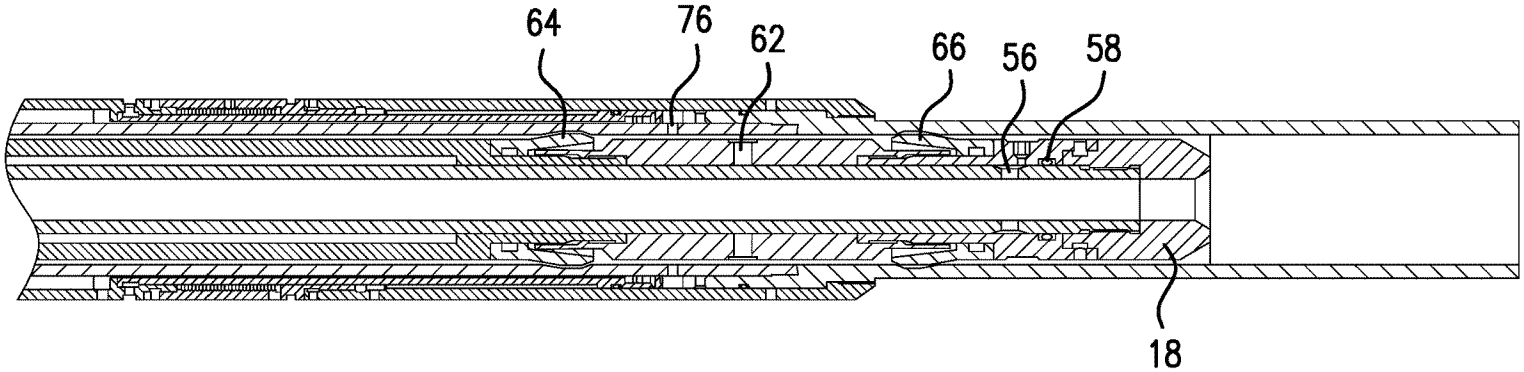

Referring to FIG. 5, the intensifier 10 is positioned within a packer assembly 70. Assembly 70 comprises a flow control nipple 72, and a hydraulic set packer 74. In embodiments, the assembly 70 could be preinstalled in a borehole or could be assembled with the intensifiers 10 and run in the hole together. The latter would reduce one trip into the borehole and hence improve efficiency. As should be understood from the foregoing discussion of the intensifier 10, pressurized fluid is provided through outlet port 62. In FIG. 5C, the port 62 can be seen to be aligned with a packer setting port 76. Aligned, is to be understood to mean that the port 62 is between the seals 64 and 66 so pressurized fluid to set the packer is indeed communicated to the packer from port 62. The packer 74 is set in the ordinary way but requiring less applied pressure in tubing fluid due to the intensifier 10. The assembly 70 is a common hydraulic set packer such that specific discussion of its components is not necessary. In some embodiments, the pressure relief valve 60 is included to limit pressurization of the packer 74 to a maximum setting pressure by opening at or near that pressure. This protects the packer from damage.

Figure 6:
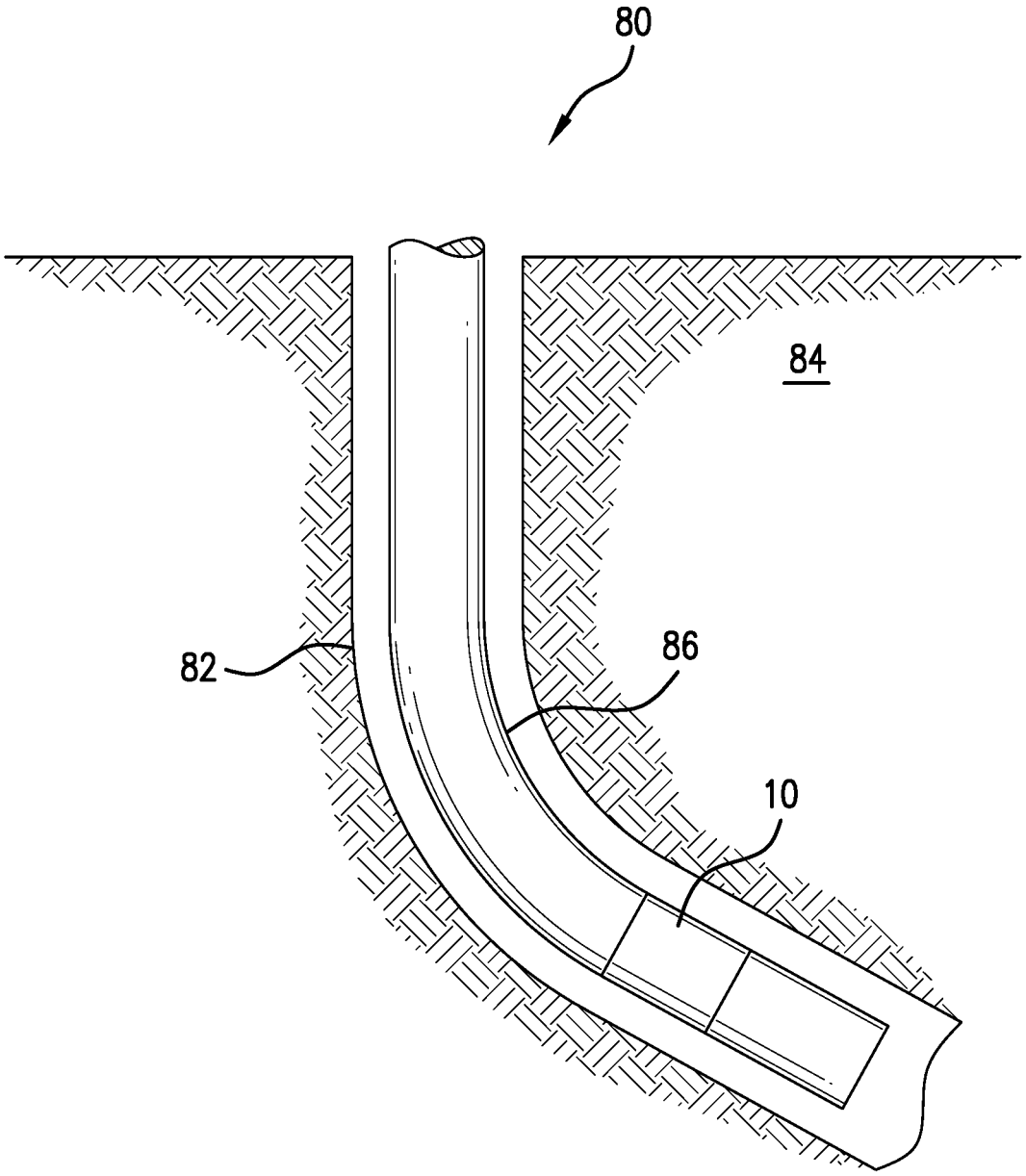
FIG. 6 is a view of a borehole system including through-tubing pressure intensifier as disclosed herein.

Referring to FIG. 6 a borehole system 80 is illustrated. The system 80 comprises a borehole 82 in a subsurface formation 84. A string 86 is disposed within the borehole 82. The intensifier 10 as disclosed herein is disposed within or as a part of the string 86.

Set forth below are some embodiments of the foregoing disclosure:

Embodiment 1: A through-tubing pressure intensifier, including an atmospheric chamber mandrel having a piston area, an intensifier mandrel having a piston area, the intensifier mandrel connected to the atmospheric chamber mandrel, and an intensifier chamber having a fluid disposed therein, the intensifier chamber being volumetrically reducible to expel the fluid.

Embodiment 2: The intensifier as in any prior embodiment, wherein the atmospheric chamber mandrel piston area is different than the intensifier mandrel piston area.

Embodiment 3: The intensifier as in any prior embodiment, wherein the intensifier mandrel piston area is smaller than the atmospheric chamber mandrel piston area.

Embodiment 4: The intensifier as in any prior embodiment, wherein the atmospheric chamber mandrel is disposed within a housing, the housing including a valve responsive to a trigger to actuate the intensifier.

Embodiment 5: The intensifier as in any prior embodiment, wherein the valve is pressure responsive.

Embodiment 6: The intensifier as in any prior embodiment, wherein the valve is electrical or acoustic signal responsive.

Embodiment 7: The intensifier as in any prior embodiment, wherein the atmospheric chamber mandrel and the atmospheric chamber housing define an atmospheric chamber therebetween.

Embodiment 8: The intensifier as in any prior embodiment, wherein the intensifier mandrel includes an auto-fill opening to the intensifier chamber.

Embodiment 9: The intensifier as in any prior embodiment, wherein during use the auto-fill opening is closed by movement of the intensifier mandrel.

Embodiment 10: The intensifier as in any prior embodiment, further including a coupling that sealably connects fluid in the intensifier chamber with a tool to be set thereby.

Embodiment 11: The intensifier as in any prior embodiment, wherein the coupling includes seals thereon.

Embodiment 12: A hydraulic set packer assembly including a flow control nipple, a hydraulic set packer connected to the nipple, and an intensifier as in any prior embodiment, disposed in the packer assembly.

Embodiment 13: The assembly as in any prior embodiment, wherein the seals on the coupling sealably contact the packer and provide a seal to convey fluid from the intensifier chamber to the packer.

Embodiment 14: A method for setting a hydraulic set packer in a borehole including applying pressure to an intensifier as in any prior embodiment, and changing a pressure at an outlet port disposed in fluid communication with the intensifier chamber relative to an input pressure applied to the intensifier.

Embodiment 15: The method as in any prior embodiment, further including triggering the intensifier.

Embodiment 16: The method as in any prior embodiment, wherein the triggering is pressuring a valve associated with the intensifier.

Embodiment 17: The method as in any prior embodiment, wherein the changing is increasing pressure relative to the applied pressure.

Embodiment 18: The method as in any prior embodiment, further comprising capturing wellbore fluid in the intensifier chamber during running.

Embodiment 19: The method as in any prior embodiment, further comprising assembling the hydraulic set packer with the intensifier prior to running.

Embodiment 20: A borehole system including a borehole in a subsurface formation, a string disposed in the borehole, and an intensifier as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A through-tubing intensifier, comprising:
an atmospheric chamber housing;
an atmospheric chamber mandrel disposed within the atmospheric chamber housing and having a piston area;
an intensifier housing connected to the atmospheric chamber housing;
an intensifier mandrel disposed within the intensifier housing and having a piston area, the intensifier mandrel connected to the atmospheric chamber mandrel;
an auto-fill opening to an intensifier chamber through at least one of the intensifier housing and the intensifier mandrel wherein during use the auto-fill opening is closed by movement of the intensifier mandrel; and
the intensifier chamber having a fluid disposed therein, the intensifier chamber being volumetrically reducible to expel the fluid.

2. The intensifier as claimed in claim 1, wherein the atmospheric chamber mandrel piston area is different than the intensifier mandrel piston area.

3. The intensifier as claimed in claim 2, wherein the intensifier mandrel piston area is smaller than the atmospheric chamber mandrel piston area.

4. The intensifier as claimed in claim 1, the atmospheric chamber housing includes a valve responsive to a trigger to actuate the intensifier.

5. The intensifier as claimed in claim 4, wherein the valve is pressure responsive.

6. The intensifier as claimed in claim 4, wherein the valve is electrical or acoustic signal responsive.

7. The intensifier as claimed in claim 4, wherein the atmospheric chamber mandrel and the atmospheric chamber housing define an atmospheric chamber therebetween.

8. The intensifier as claimed in claim 1, further including a coupling that sealably connects fluid in the intensifier chamber with a tool to be set thereby.

9. The intensifier as claimed in claim 8, wherein the coupling includes seals thereon.

10. A hydraulic set packer assembly comprising:
a flow control nipple;
a hydraulic set packer connected to the nipple; and
an intensifier as claimed in claim 1 disposed in the packer assembly.

11. The assembly as claimed in claim 10, wherein a coupling having seals thereon sealably connects the packer to the intensifier to convey fluid from the intensifier chamber to the packer.

12. A method for setting a hydraulic set packer in a borehole comprising:
applying pressure to an intensifier as claimed in claim 1; and
changing a pressure at an outlet port disposed in fluid communication with the intensifier chamber relative to an input pressure applied to the intensifier.

13. The method as claimed in claim 12, further including triggering the intensifier.

14. The method as claimed in claim 13, wherein the triggering is pressuring a valve associated with the intensifier.

15. The method as claimed in claim 12, wherein the changing is increasing pressure relative to the applied pressure.

16. The method as claimed in claim 12, further comprising capturing wellbore fluid in the intensifier chamber during running.

17. The method as claimed in claim 12, further comprising assembling the hydraulic set packer with the intensifier prior to running.

18. A borehole system comprising:
a borehole in a subsurface formation;
a string disposed in the borehole; and
an intensifier as claimed in claim 1 disposed within or as a part of the string.

19. A method for setting a hydraulic set packer in a borehole comprising:
applying pressure to a through-tubing pressure intensifier, comprising:
an atmospheric chamber mandrel having a piston area;
an intensifier mandrel having a piston area, the intensifier mandrel connected to the atmospheric chamber mandrel; and
an intensifier chamber, the intensifier chamber being volumetrically reducible to expel a fluid;
capturing wellbore fluid in the intensifier chamber during running; and
changing a pressure at an outlet port disposed in fluid communication with the intensifier chamber relative to an input pressure applied to the intensifier.

* * * * *